US009976728B2

(12) United States Patent
Luu et al.

(10) Patent No.: US 9,976,728 B2
(45) Date of Patent: May 22, 2018

(54) CONNECTOR ASSEMBLY FOR MOUNTING LIGHTING FIXTURE

(71) Applicant: GE Lighting Solutions, LLC, East Cleveland, OH (US)

(72) Inventors: Philippe Luu, Lachine (CA); Sebastien Magnan, Lachine (CA); Christopher Henry Wilson, Lachine (CA); Jeremy Wayne Yon, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 126 days.

(21) Appl. No.: 14/831,952

(22) Filed: Aug. 21, 2015

(65) Prior Publication Data

US 2017/0051905 A1 Feb. 23, 2017

(51) Int. Cl.

| | |
|---|---|
| ***F21V 23/06*** | (2006.01) |
| ***F21V 21/005*** | (2006.01) |
| *F21S 2/00* | (2016.01) |
| *F21S 8/06* | (2006.01) |
| *F21V 15/015* | (2006.01) |
| *F21S 4/28* | (2016.01) |

(52) U.S. Cl.

CPC ..... *F21V 21/005* (2013.01); *F21S 2/00* (2013.01); *F21S 4/28* (2016.01); *F21S 8/06* (2013.01); *F21V 15/015* (2013.01)

(58) Field of Classification Search

CPC ..... F21V 21/005; F21S 2/00; F21S 8/06

See application file for complete search history.

(56) References Cited

U.S. PATENT DOCUMENTS

| | | | |
|---|---|---|---|
| 4,707,766 | A | 11/1987 | Bertozzi et al. |
| 4,726,781 | A | 2/1988 | Bernhart et al. |
| 5,624,202 | A | 4/1997 | Grierson |
| 5,658,066 | A | 8/1997 | Hirsch |
| 6,530,674 | B2 | 3/2003 | Grierson et al. |
| 6,769,784 | B2 | 8/2004 | Yaphe et al. |
| 6,796,676 | B2 | 9/2004 | Severtson et al. |

(Continued)

FOREIGN PATENT DOCUMENTS

| | | | |
|---|---|---|---|
| DE | 202014007923 | U1 | 10/2014 |
| GB | 900552 | A | 7/1962 |

(Continued)

OTHER PUBLICATIONS

European Search Report issued in connection with corresponding EP Application No. 16166666.4 dated Jun. 22, 2016.

(Continued)

*Primary Examiner* — Elmito Breval

(74) *Attorney, Agent, or Firm* — Peter T. DiMauro; GE Global Patent Operation

(57) ABSTRACT

Provided is a lighting assembly comprising a pin end connector and a knuckle end connector. The pin end connector includes a protrusion having at least one wall and a rotational fastener configured to be received through and retained by the wall. The knuckle end connector includes a discontinuous seat having a first opening configured to receive the protrusion and a second opening configured to receive the rotational fastener. The pin end connector is configured to be received by the knuckle end connector and pivotally rotate to attach the first connector assembly with the second connector assembly. Also provided is a method for joining the pin end connector with the knuckle end connector.

17 Claims, 5 Drawing Sheets

(56) References Cited

U.S. PATENT DOCUMENTS

| | | | |
|---|---|---|---|
| 7,380,957 | B2 | 6/2008 | Lanczy |
| 2007/0247845 | A1 | 10/2007 | Bansbach |

FOREIGN PATENT DOCUMENTS

| | | | |
|---|---|---|---|
| JP | 2006-180807 | A | 7/2006 |
| KR | 20140066129 | A | 5/2014 |
| WO | 2012052477 | A1 | 4/2012 |

OTHER PUBLICATIONS

Office Action issued in connection with corresponding EP Application No. 16166666.4 dated Jan. 4, 2018.

CONNECTOR ASSEMBLY FOR MOUNTING LIGHTING FIXTURE

FIELD OF THE INVENTION

The present invention is related to lighting fixtures. More specifically, the present invention is related to lighting fixture connector assemblies.

BACKGROUND OF THE INVENTION

Lighting fixtures, such as luminaires, can be suspended from a support, such as a ceiling, at a height that can be ten feet or more in the air from a ground surface. A lighting fixture is often connected to other lighting fixtures to form continuous rows. Typically, lighting fixtures are constructed of metal and are of moderate weight. While the lighting fixtures can have a relatively small cross-section, their length generally ranges from about 4-8 feet. These characteristics can make lighting fixtures difficult to handle.

Particularly, the conventional process of assembling and installing lighting fixtures can be challenging, and require installers to engage in complex, dangerous and cumbersome installation processes. This conventional assembly requires several installers to work in tandem. Such processes are not only time-consuming, but can be costly to consumers.

Other conventional lighting fixture assemblies require joining adjacent lighting fixtures in a linear fashion. For example, two lighting fixtures are joined by positioning the lighting fixtures parallel to one another and abutting the fixtures against one another (e.g., end-to-end). The lighting fixtures are joined using multiple pairs of fasteners (screws, nuts and bolts, and other similar retainer devices). For example, screws are provided on each side of the lighting fixture to form a joint by connecting end sections of each lighting fixture.

The joint of the adjacent light fixtures must be tight to provide a weight transfer through the joint. For elongated lighting fixtures with lengths from about 4-8 feet, for example, the act of mounting the fixtures at heights about 10 feet in the air is cumbersome. This mounting typically requires at least two installers and a significant time commitment to complete the assembly process.

Other conventional installation techniques include installing a first lighting fixture, securing a second lighting fixture at an initial free end of the first lighting fixture, and positioning the second lighting fixture toward the first lighting fixture where a joint is made. Although this alternative method can be completed with a single person, current lighting fixtures are not designed to accommodate this configuration.

An additional problem with the conventional installation techniques is the requirement to be mounted on a parallel or co-linear planes (e.g., abutting the lighting fixtures end-to-end). Without these co-linear planes, the fasteners cannot properly attach the lighting fixtures together.

SUMMARY OF THE INVENTION

Given the aforementioned deficiencies, a need exists for assemblies and methods that facilitate installation of lighting fixtures for attachment to one another on planes that are not co-linear. Additionally, a need exists for methods to reduce associated installation and/or maintenance times.

In the embodiments, lighting fixtures are joined using a pin end connector and a knuckle end connector. The pin end connector includes a protrusion having at least one wall and a rotational fastener configured to be received through and retained by the wall. In some embodiments, the rotational fastener is configured to be removably connected from the wall of the protrusion. The knuckle end connector includes a discontinuous seat having a first opening configured to receive the protrusion and a second opening configured to receive the rotational fastener. The pin end connector is configured to be received by the knuckle end connector and pivotally rotate to attach the pin end connector assembly with the knuckle end connector.

In other embodiments, the pin end connector is configured to rotate a first lighting fixture about a pivot point from a first position to a second lighting fixture to a second position to the second lighting fixture. The first position forms an angle of separation between the first lighting fixture and the second lighting fixture along the axial length of each fixture. The second position is substantially parallel to the second lighting fixture.

In still other embodiments, the pin end connector further includes one or more support tab members and the knuckle end connector further includes one or more support tab connectors. In these embodiments, the support tab connectors are configured to receive at least a portion of the support tab members.

Another advantage is the lighting fixtures, when continuously joined, can be removed and reinstalled without removing adjacent lighting fixtures. The ability to disjoin and rejoin continuous lighting fixtures may reduce the time of removal and installation during maintenance.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

To provide a thorough understanding of the present disclosure, embodiments of the present invention are described below with reference to the accompanying drawings, wherein.

DETAILED DESCRIPTION

While the present invention is described herein with illustrative embodiments for particular applications, it should be understood that the invention is not limited thereto. Those skilled in the art with access to the teachings provided herein will recognize additional modifications, applications, and embodiments within the scope thereof and additional fields in which the invention would be of significant utility.

Unless defined otherwise, technical and scientific terms used herein have the same meaning as is commonly understood by one of ordinary skill in the art to which this disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean either, any, several, or all of the listed items.

The use of "including," "comprising," or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect.

Figure 1:
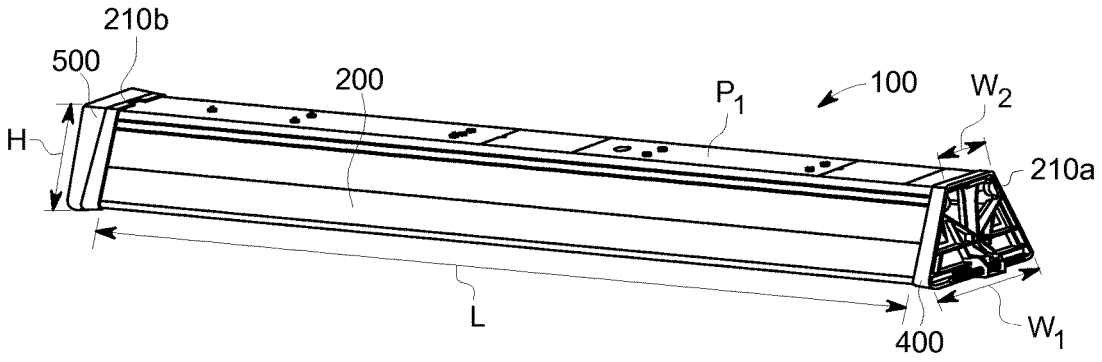
FIG. 1 depicts a perspective view of a lighting fixture with a pin end support in accordance with exemplary embodiments of the present invention.

FIG. 1 illustration of a lighting fixture 100 in accordance with an example embodiment of the present invention. The lighting fixture 100 includes a fixture housing 200 and one or both of a pin end support 400 and a knuckle end support 500.

The fixture housing 200 is typically elongated having an axial length L, a height H, a width. In accordance with some embodiments, the axial length L is greater than the height H. The lighting fixture 100 can have a first width W1 and a second width W2. For example, where the lighting fixture 100 has a trapezoidal cross-section, as illustrated, the lighting fixture 100 has the first width W1 that is greater than the second width W2. Other cross-sectional geometric shapes are considered within the scope of this invention, such as circles, ovals, squares, rectangles, diamonds, and hexagons, among others.

As illustrated in FIG. 1, the axial length L and the second width W2 form a first plane P1 on one surface of the height. Similarly, the axial length L and the first width W1 form a second plane (not visible) separate from and parallel to the first plane P1. The first plane P1 may be used to affix the lighting fixture 100 to another surface (e.g., a ceiling mount) and the second plane (not visibly illustrated) may be used as a light-emitting surface (not illustrated) covering at least a portion of the axial length L.

The fixture housing 200 includes a first end 210*a* located at one end of the axial length L and a second end 210*b* located at a second end of the axial length L opposite the first end 210*a*. In some embodiments, the fixture housing 200 is integrally formed with connector assemblies (e.g., a pin end support 400 and a knuckle end support 500, described below) for joining one lighting fixture to an adjacent lighting fixture. For example, the ends (210*a*, 210*b*) can be manufactured to include the pin end support 400 or the knuckle end support 500.

In some embodiments, the ends (210*a*, 210*b*) are not integrally formed with connector assemblies. Here, the first end 210*a* and the second end 210*b* of the fixture housing 200 each include a contact edge (not illustrated). The pin end support 400 and the knuckle end support 500 can be configured to mate and/or fit with a contact edge of the first end 210*a* of the fixture housing 200 and a contact edge of the second end 210*b* of the fixture housing 200.

Figure 2:
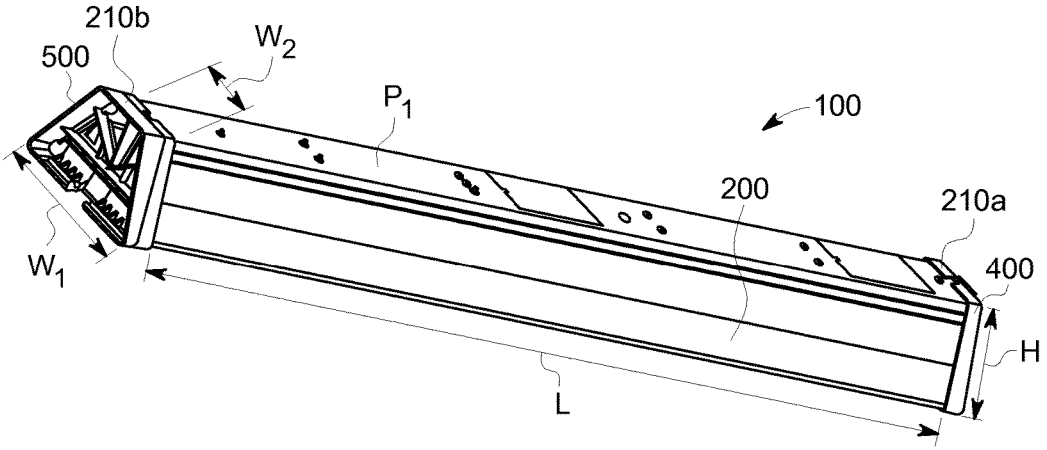
FIG. 2 depicts a perspective view of the lighting fixture of FIG. 1 with a knuckle end support opposite the pin end support.

As illustrated FIGS. 1 and 2, the pin end support 400 is provided on the first end 210*a* and the knuckle end support 500 is provided on the second end 210*b*. This arrangement allows each lighting fixture 100 to be connected in series with another lighting fixture 100 for a continuous lighting structure.

Alternatively, the lighting fixture can include the pin end support 400 or the knuckle end support 500 on the first end 210*a* and the second end 210*b*. Here, the lighting fixtures 100 having only pin end supports 400 can be joined with lighting fixtures having knuckle end supports on the first end 210*a* and the second end 210*b*.

Figure 3:
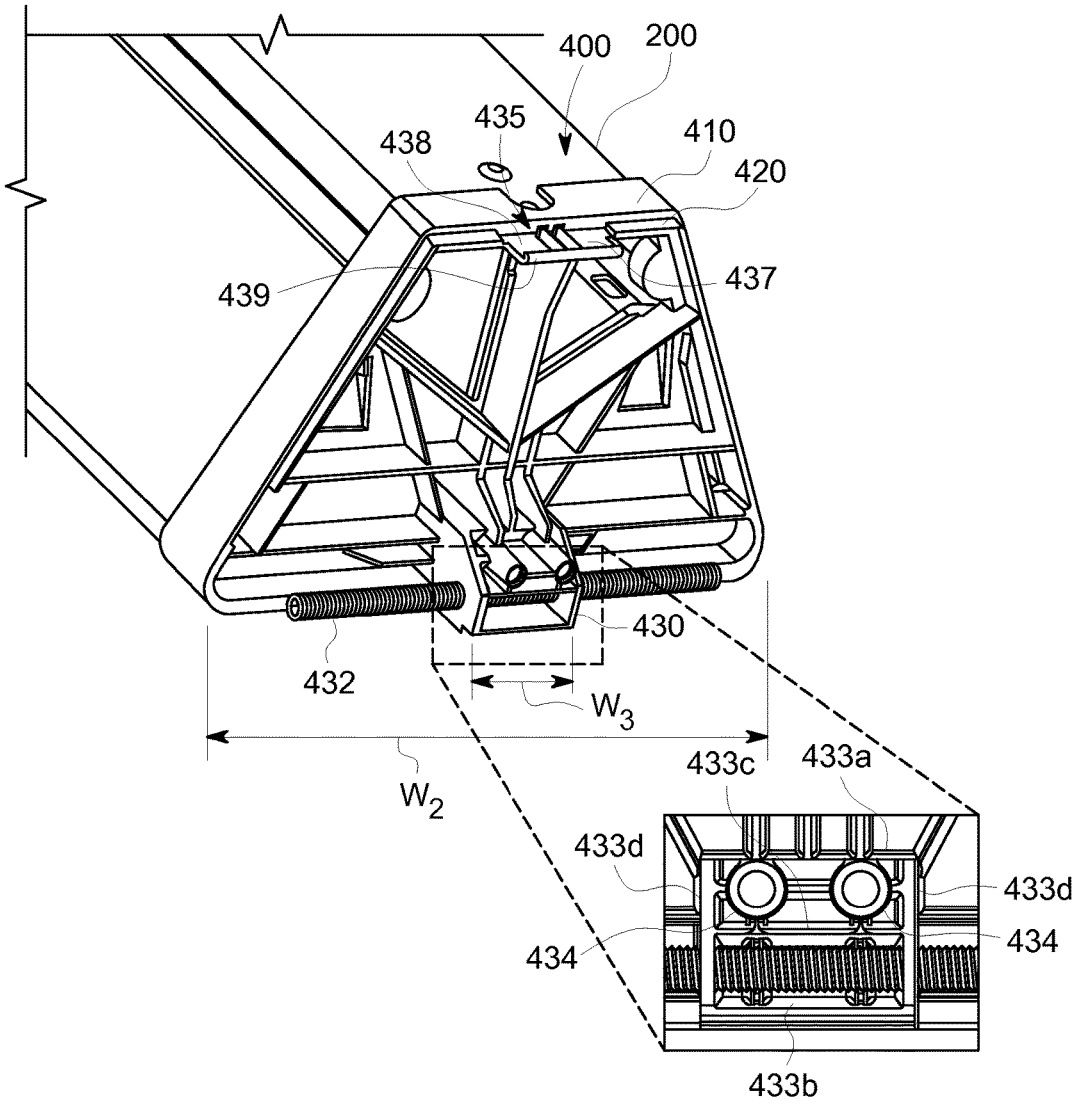
FIG. 3 depicts a perspective view of the pin end support of FIG. 1 including a front view of the protrusion in a call-out.

FIG. 3 depicts the pin end support 400 in accordance with other embodiments. The pin end support 400 includes a first pin-end support side 410 proximal to the fixture housing 200 and a second pin-end support side 420 distal to the fixture housing 200. In some embodiments, the pin end support 400 is not integral to the fixture housing 200 and is attached, or otherwise coupled, to the fixture housing 200. When the pin end support 400 is provided, for example, on the first end 210*a* of the fixture housing 200, the first pin-end support side 410 is coupled to the first end 210*a* of the fixture housing 200.

The second pin-end support side 420 includes a protrusion 430 having a third width W3 perpendicular to the axial axis L. The protrusion 430 may be of any shape, such as cylinder, square, and rectangular, among others. In the example embodiment of FIG. 3, the protrusion 430 has substantially rectangular in cross-section.

The protrusion 430 in one embodiment is positioned in a direction that extends beyond the fixture housing 200, specifically the second pin-end support side 420 (as illustrated in FIG. 3). In another embodiment, the protrusion 430 is positioned to conceal the protrusion 430 within the fixture housing 200 such that the protrusion 430 does not extend beyond the second pin-end support 420.

The protrusion 430 can be made of any durable and rigid material suitable for the application of lighting installation. Suitable materials may include a wide-array of plastic and/or metal materials. The protrusion 430 may be formed (e.g., manufactured) using any number of methods, including but not limited to injection molding and/or sheet metal formation. Methods may form the protrusion 430 independent of or formed with other features within the second pin-end support side 420.

The protrusion 430 has at least one side wall configured to receive and retain one or more rotational fasteners (e.g., pins 432). For example, where the protrusion 430 has a rectangular cross-section, the protrusion 430 includes a top wall 433*a*, a bottom wall 433*b*, and two side walls 433*d*, as illustrated in the call-out of FIG. 3. The top wall 433*a* and the bottom wall 433*b* may be of the third width W3.

In some embodiments, the second pin-end support side 420 can include more than one protrusion 430. Each protrusion 430 can have a similar cross-section and positioned within the second pin-end support side 420, along the width of the fixture housing 200.

In other embodiments, the protrusion 430 includes an inner wall 433*c*. The inner wall 433*c* may be necessary to provide additional structural support where the protrusion includes one or more tubes 434. The tubes 434 are coupled at least at one ends to the inner wall 433*c* of the protrusion 430, or are otherwise secured in the protrusion 430. The tubes 434 are positioned on an axis separate from and parallel to the axial length L of the fixture housing 200. The tubes 434 are configured to receive and retain a fastener.

Such fasteners can include, but are not limited to, pins, screws, nuts and bolts, and the like.

The protrusion 430 is configured to receive one or more rotational fasteners. The rotational fasteners can be any hardware that mechanically join the pin end support 400 with the knuckle end support 500. The rotational fastener can be any rigid means that fastens with the ability to rotate when joining the end supports 400, 500. For example, the rotational fastener can be a pin, rod, bowel, or tube, among others. For exemplary purposes the rotational fastener is hereinafter referred to as a pin 432.

The side walls 433*d* of the protrusion 430 is configured to receive one or more pins 432. For example, as illustrated in an exemplary embodiment of FIG. 3, the pin 432 is received by the two side walls 433*d*. As another example, a first pin 432 can pass through both side walls 433*d* and a second pin 432 can pass through both side walls 433*d* at a position different than the first pin 432. Also, one pin 432 may be received by one side wall 433*d* and a second pin may be received by the second side wall 433*d*.

The pin 432 has a length larger than the protrusion 430 but smaller than the width of the lighting fixture. For example, where the lighting fixture 100 has a trapezoidal cross-section as illustrated, the pin 432 should be larger than the third width W3 of the protrusion 430 but smaller than the first width W1. The pin 432 is desirably constructed of a material that is rigid but not brittle. For example, the pin 432 is a steel pin or a plastic (e.g., polythene) dowel.

In some embodiments, the pin 432 is configured to be removable. For example, the pin 432 may include threading or other indentations (as illustrated in FIG. 4) to allow removability and replacement of the pin 432 during servicing of the lighting fixture, for example.

The pin end support 400 can include one or more support tab members (or securing element or pin-end support end member) 435. Each support tab member 435 is configured to attach or otherwise connect with a support tab connector 540 when the lighting fixture 100 is joined with another lighting fixture 100 described below.

The support tab member 435 is coupled to an upper surface 437 of the pin end support 400 and is positioned in a direction that protrudes from the pin end support 400. The support tab member 435 can have a flattened portion 438 and tapers with a raised portion 439 oriented in at an angle relative to the axial length L. The raised portion 439 may be, for example, a hook or lip.

Figure 4:
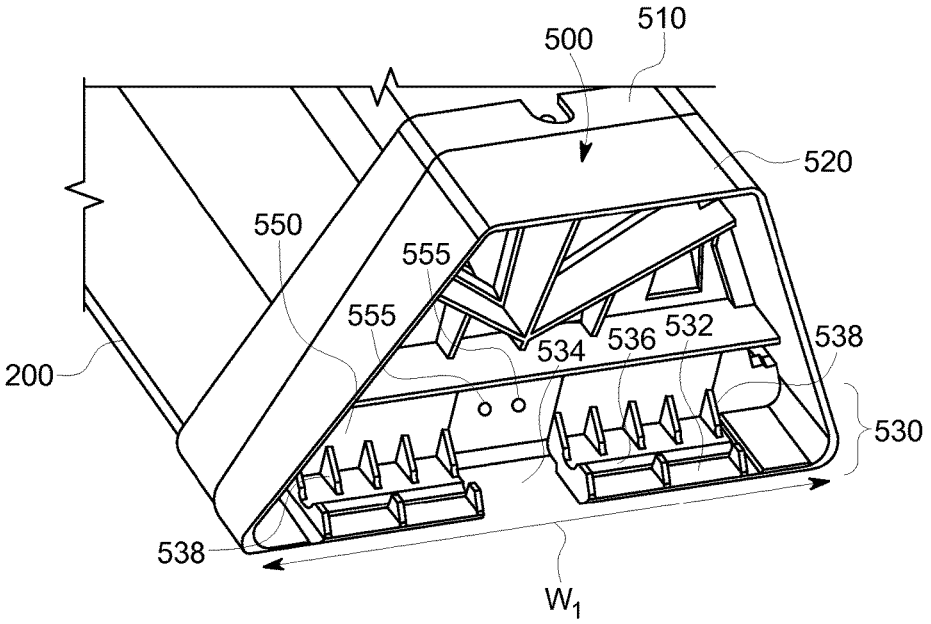
FIG. 4 depicts a partial perspective view of the knuckle end support of FIG. 2.

FIG. 4 depicts a knuckle end support 500 in accordance with the embodiments. The knuckle end support 500 includes a first knuckle-end support side 510 proximal to the fixture housing 200 and a second knuckle-end support side 520 distal to the fixture housing 200. In the embodiments, the knuckle end support 500 can be integrated with, or coupled to, the fixture housing 200.

The second knuckle-end support side 520 includes a discontinuous seat 530 having a receiving plate 532, a gap 534, a depression 536, and teeth 538. The discontinuous seat 530 is oriented in a direction generally perpendicular to the axial length L and arranged at a lower portion of the knuckle end support 500. The discontinuous seat 530 is configured to seat or otherwise receive the protrusion 430 and the pin 432 of at least a second lighting fixture 100. Specifically, the protrusion 430 is received by the gap 534 and the pin 432 is received by the depression 536, as described below.

The receiving plate 532 is a generally flat surface of the discontinuous seat 530 that has an axis perpendicular to the axial length L of the fixture housing 200. Other features of the discontinuous seat 530 such as the depression 536 and the teeth 538 are incorporated into the receiving plate 532.

The gap 534 is a void along the first width W1 of the discontinuous seat 530, and the gap 534 is perpendicular to the axial length L. The gap 534 is exposed at a side of the knuckle end support 500 away from the fixture housing 200. The gap 534 has a width at least the third width W3 of the protrusion 430, measured in a direction perpendicular to the axial length L.

The gap 534 is configured to, and sized and shaped for, receiving the protrusion 430 of the pin end support 400. For example, where the protrusion 430 has a rectangular cross section having the third width W3, the gap 534 should also have a similar rectangular cross section and a width slightly greater than the third width W3 of the protrusion 430, thus allowing the protrusion 430 to be seated within the gap 534.

The depression 536 is a void within the discontinuous seat 530 also along the first width W1. The depression 536 is configured to, and sized and shaped for, receiving the pin 432 of the pin end support 400. Where the protrusion 430 and pin 432 are concealed within the first knuckle-end support side 510, the discontinuous seat 530, including the gap 534 and the depression 536, may correspondingly protrude beyond the second knuckle-end support side 520 to receive the protrusion 430 and the pin 432. The pin 432 may be fixed relative to the protrusion 430 but allowed to rotate within and relative to the discontinuous seat 530. Alternatively, the pin 432 may be fixed relative to the discontinuous seat 530 and rotate, relative to the protrusion 430.

In still other embodiments, more than one gap 534 and/or depression 536 can be present within the discontinuous seat 530. For example, where two protrusions 430 are present in more than one position on the pin end support 400, the discontinuous seat 530 may contain two gaps 534 each positioned to receive a protrusion 430. Similarly, where two pins 432 are present in more than one position of the protrusion 430, the discontinuous seat 530 may contain two depressions 536 each positioned to receive a pin 432.

The teeth 538 are provided to inhibit the pin 432 from sliding or rolling out of place (e.g., rolling out of place of the depression 536) during joining two lighting fixtures 100. The teeth 538 may be positioned on either or both sides of the depression 536 to prevent rolling of the pin 432 in either direction. Additionally or alternatively, the teeth 538 can be shaped to guide the pin 432 into the depression 536. For example, the teeth 538 are angled (e.g., sloped) in a direction to facilitate movement of the pin 432 into the depression 536, as illustrated in FIG. 4.

In yet other embodiments, second knuckle-end side support side 520 can include a partition 550 defined with one or more apertures 555. The partition 550 is positioned adjacent the discontinuous seat 530 and generally perpendicular to the axial length L. The partition 550 will typically be positioned at a location approximately near where the first knuckle-end support side 510 meets the second knuckle-end support side 520.

In embodiments where the pin end support 400 contains tubes 434, the second knuckle-end side support side 520 can contain the apertures 555. The tubes 434 and apertures 555 can be used where one lighting fixture 100 requires removal and re-installed in a row of continuous lighting fixtures 100. Upon re-installation, the lighting fixture 100 that is removed is re-joined to an adjacent lighting fixture 100 in the series.

Re-joining occurs by securing fastener(s) through the apertures 555 of the adjacent lighting fixture 100 into the tubes 434 of the replaced lighting fixture 100. Stated another way, the tubes 434 may be used to join two lighting fixtures 100 together on co-linear planes. Typically, use of the tubes 434 and the apertures 555 occur during maintenance or replacement and are not used while the protrusion 430 and the pin 432 are located in the discontinuous seat 530.

Figure 5:
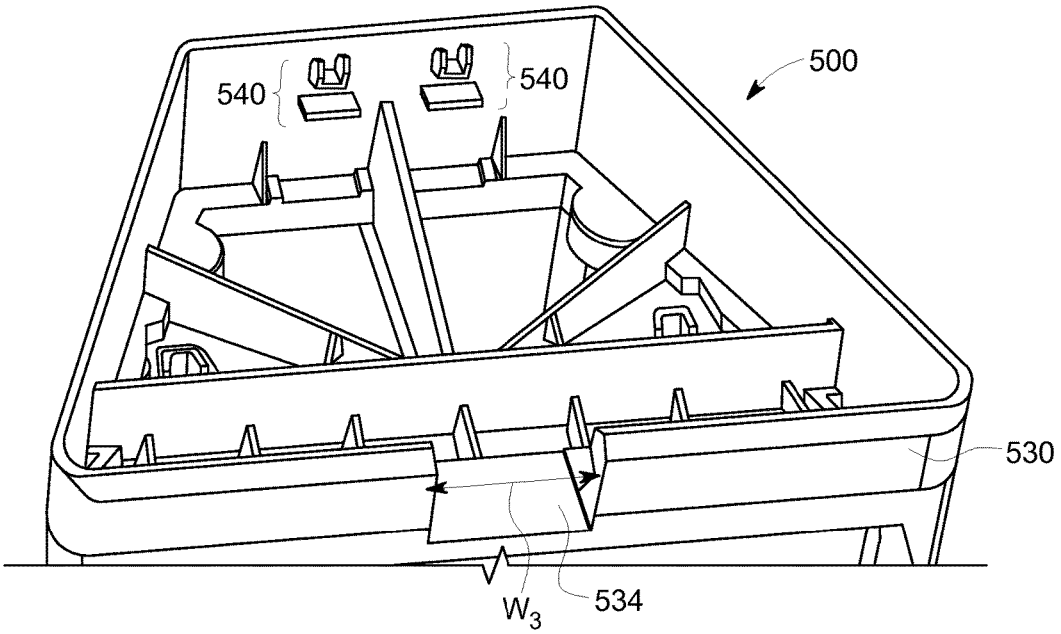
FIG. 5 depicts a bottom perspective view of the knuckle end support of FIG. 2.

The second knuckle-end support side 520 can also include one or more support tab connectors 540 illustrated in FIG. 5. The support tab connector 540 is located at an upper portion of the fixture housing 200 or at an upper portion of the knuckle end support 500. The support tab connector 540 includes an opening configured to receive at least the raised portion 439 of the support tab member 435 of the pin end support 400. Securing the support tab member 435 to the support tab connector 540 may prevent light from escaping (e.g., light leakage) from an opening at the second width W2. Rather, light will be directed to and emitted from the light-emitting surface located at the second plane of the fixture housing 200.

The lighting fixture 100 can also include a pin cap and a knuckle cap (not illustrated). In these embodiments, the ends of the pin end support 400 and the knuckle end support 500 are configured to receive and retain the pin cap and the knuckle cap. The pin and knuckle caps are configured to prevent leakage of light from the lighting fixture 100, as well as protect the outer surface of the pin end support 400 and the knuckle end support 500, respectively. Each of the pin caps and the knuckle caps are preferably made of plastic, but may be made of a material similar to that of the lighting fixture 100 or any other suitable material.

The pin cap and knuckle cap each includes an end wall and a peripheral edge. The end walls can have a shape identical to the cross-section of the lighting fixture 100 and are directed at a position away from the lighting fixture 100. The peripheral edge of the pin cap can be configured to securely fit over the second knuckle-end support side 520, and may further include engagement features configured to connect the pin cap to the second knuckle-end support side 520.

The peripheral edge of the pin cap may be continuous. The peripheral edge of the knuckle cap may be configured to securely fit over the second pin-end support side 420, and may further include engagement features configured to connect the knuckle cap to the second pin-end support side 420.

Figure 6A:
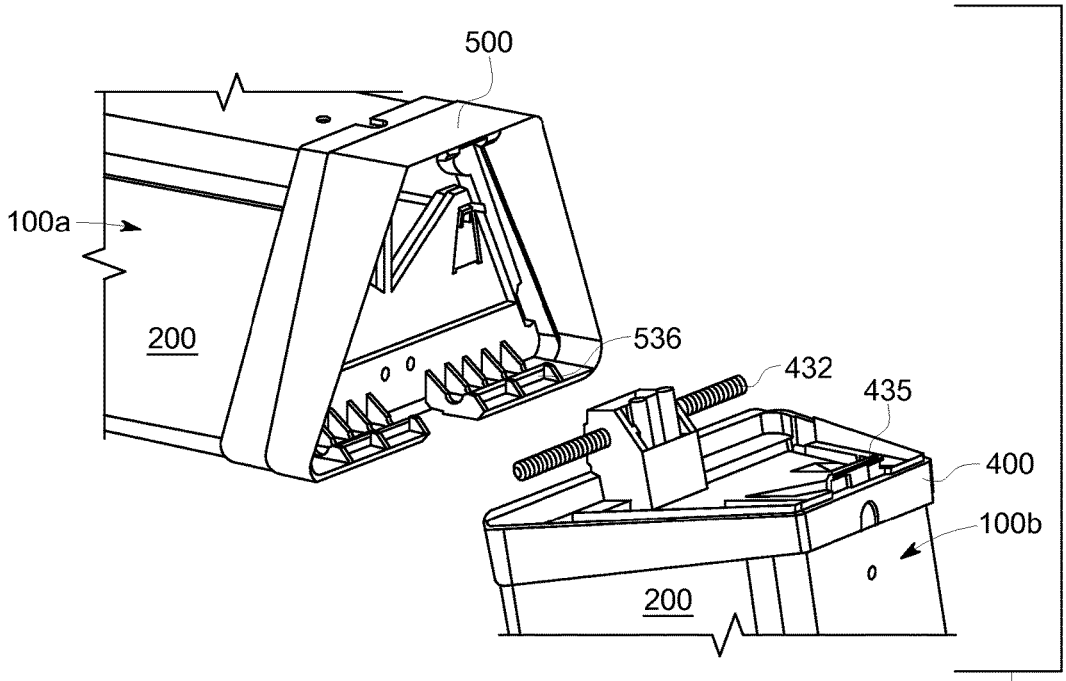
FIGS. 6A-6C depict a method of assembling the pin end support of a first lighting fixture with the knuckle end support of a second lighting fixture.
Figure 6B:
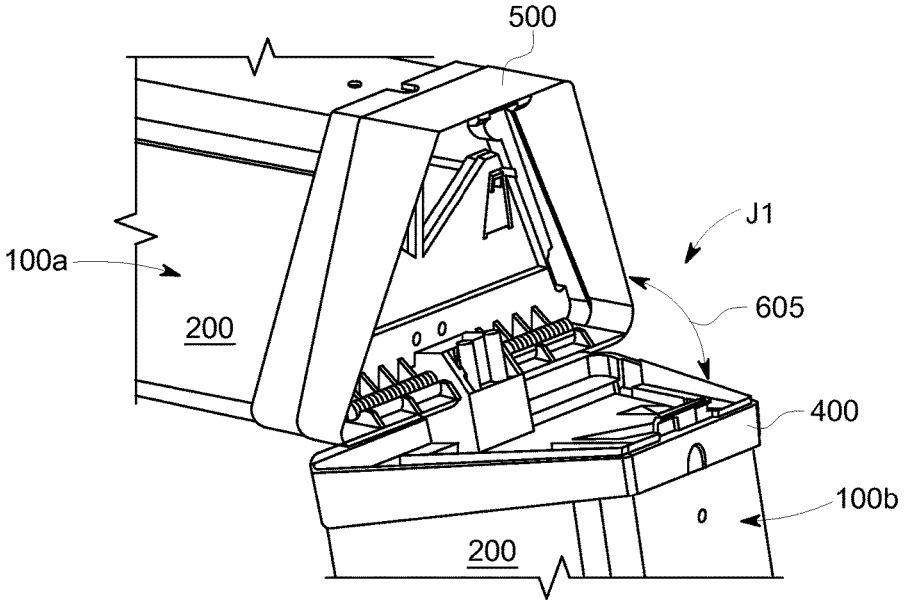
Figure 6C:
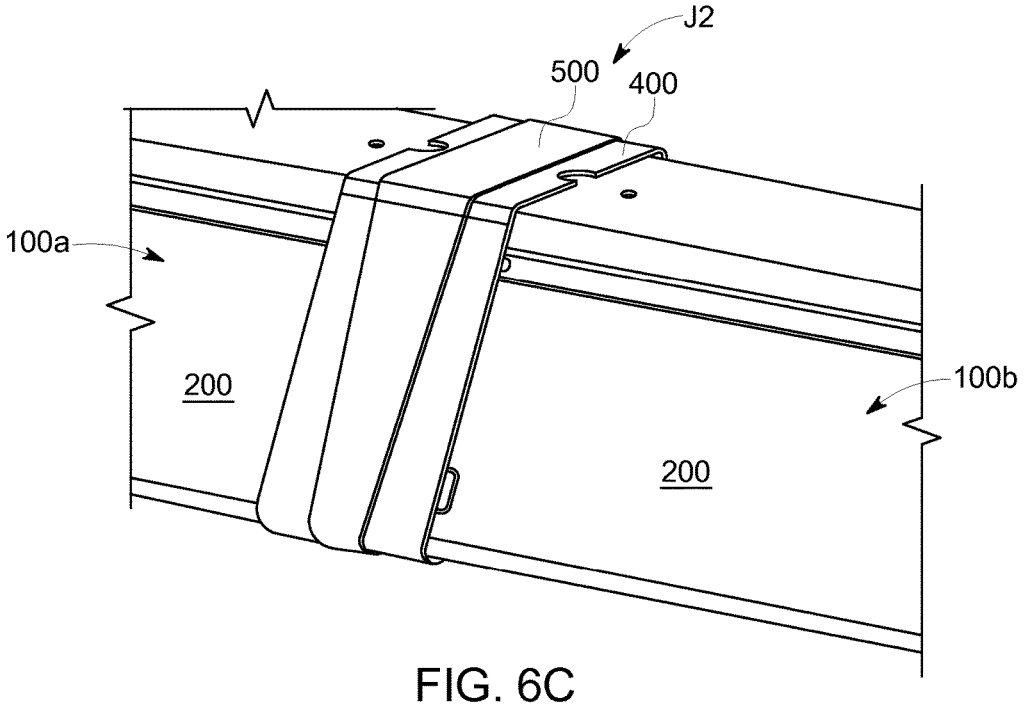

FIGS. 6A-6C is an illustration of an exemplary method of assembling the pin end support 400 of a first lighting fixture 100*a* with the knuckle end support 500 of a second lighting fixture 100*b*. Each of the lighting fixtures (100*a*, 100*b*) includes a fixture housing 200, a pin end support 400, and a knuckle end support 500, substantially as described in detail above. Alternatively, one lighting fixture 100 may include only pin end supports 400 and the other lighting fixture may include only knuckle end supports 500.

As illustrated at a first position in FIG. 6A, the pin end support 400 of the first lighting fixture 100*a* is positioned proximal to the knuckle end support 500 of the second lighting fixture 100*b*. The second lighting fixture 100*a* is positioned such that the fixture housing 200 of the second lighting fixture 100*a* is separated from the first lighting fixture 100*a*.

At a second position in FIG. 6B, the pin 432 of the pin end support 400 is positioned within the depression 536 of the knuckle support 500. Once positioned, the second lighting fixture 100*b* is able to hang freely with respect to the first lighting fixture 100*a*, forming an angle 605 and creating a pivot (pivoting joint) J1.

The angle 605 formed between the first lighting fixture 100*a* and the second lighting fixture 100*b* is measured between the axial length L of each fixture 100*a*, 100*b*. The angle 605 of separation can be any angle greater than 0 degrees but less than 180 degrees. For example, the angle 605 is approximately 90 degrees where the second lighting fixture 100*b* freely hangs, under the weight of gravity, from the first lighting fixture 100*b*. Stated another way, the first lighting fixture 100*a* is positioned substantially perpendicular to the second lighting fixture 100*b*.

The pivoting joint J1 allows the second lighting fixture 100*b* to rotate about the pin 432. In operation, the second lighting fixture 100*b* rotates about the about the pin 432 at the pivoting joint J1 from a first location illustrated in FIG. 6B I to a second location illustrated in FIG. 6C. For example, the second lighting fixture rotates about the pin 432 from a position substantially perpendicular to the first lighting fixture 100*a* to a location substantially co-linear to the first lighting fixture 100*a*.

At a third position in FIG. 6C, the second lighting fixture 100*b* has been rotated about the pivoting joint J1 to a position substantially co-linear to the first lighting fixture 100*a* providing a secure joint J2 between the first lighting fixture 100*a* and the second lighting fixture 100*b*.

As described above, the pin end support 400 of the second lighting fixture 100*b* can be secured to the knuckle end support 500 of the first lighting fixture 100*a* by way of one or more support tab members 435 and support tab connectors 540. In these embodiments, the support tab members 435 and the support tab connectors 540 engage each other and assist in providing the secure joint J2 and preventing light leakage.

In yet other embodiments, the lighting fixtures 100 can also include self-centering features to ensure alignment, overlapping non-structural features to present tighten the secure joint J2, and a latching-tab feature located at the peripheral edges of each of the pin end support 400 and the knuckle end support 500 to mechanically secure the joint J2 without requiring a separate fastener or user manipulation at the pivoting joint J1.

Alternatively, the method can further include securely supporting the second lighting fixture 100*b* to allow access to electrical connections. The electrical connections may or may not be concealed.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

What we claim is:

1. A connection assembly for a lighting fixture comprising:

a first connector assembly (i) connectable to a first housing, (ii) including a protrusion having at least one wall perpendicular to a length of the first housing, and (iii) including a rotational fastener configured to be received through the wall; and a second connector assembly (i) connectable to a second housing, (ii) including a discontinuous seat having a first opening configured to receive the protrusion, and (iii) a second opening configured to receive the rotational fastener, wherein the discontinuous seat further includes a plurality of teeth positioned proximal to the second opening and configured to inhibit the rotational fastener from moving out of the second opening;

wherein receiving the protrusion and the rotational fastener into the discontinuous seat forms a pivoting joint where the first connector assembly is located at a first position that is separated from the first connector assembly by an angle.

2. The connection assembly of claim 1, wherein the first connector assembly is configured to rotate the first connector housing about the pivoting joint from the first position to a second position co-linear to the second connector assembly and second housing.

3. The connection assembly of claim 1, wherein the rotational fastener is configured to be removably connected from the wall of the protrusion.

4. The connection assembly of claim 1, wherein the rotational fastener is a first rotational fastener at a first position along the wall and a second mounting fastener is positioned at a second position along the wall, the first rotational fastener configured to be received by the second opening and the second rotational fastener is configured to be received by a third opening positioned within the discontinuous seat.

5. The connection assembly of claim 1, wherein the first connector assembly further includes one or more support tab members and the second connector further includes one or more support tab connectors and wherein the support tab connectors are configured to receive at least a portion of the support tab members.

6. The connection assembly of claim 1, wherein the first connector assembly further includes at least one tube affixed to the wall and the second connector assembly further includes a partition perpendicular to the discontinuous seat, the partition having at least one aperture defined therein, the aperture configured to accept a fastener and align the fastener with the tube thus positioning the first connector assembly substantially parallel with the second connector assembly.

7. A lighting fixture assembly comprising:

a first connector assembly (i) connected to a first portion of a housing, (ii) including a protrusion having at least one wall perpendicular to a length of the first housing, and (iii) including a rotational fastener configured to be received through the wall; and a second connector assembly (i) connected to a second portion of a the housing opposite the first portion, (ii) including a discontinuous seat having a first opening configured to receive the protrusion, and (iii) a second opening configured to receive the rotational fastener, wherein the discontinuous seat further includes a plurality of teeth positioned proximal to the second opening and configured to inhibit the rotational fastener from moving out of the second opening;

wherein receiving the protrusion and the rotational fastener into the discontinuous seat forms a pivoting joint where the first connector assembly is located at a first position that is separated from the first connector assembly by an angle.

8. The connection assembly of claim 7, wherein the first connector assembly is configured to rotate the first connector housing about the pivoting joint from the first position to a second position co-linear to the second connector assembly and second housing.

9. The connection assembly of claim 7, wherein the rotational fastener is configured to be removably connected from the wall of the protrusion.

10. The connection assembly of claim 7, wherein the rotational fastener is a first rotational fastener at a first position along the wall and a second mounting fastener is positioned at a second position along the wall, the first rotational fastener configured to be received by the second opening and the second rotational fastener is configured to be received by a third opening positioned within the discontinuous seat.

11. The connection assembly of claim 7, wherein the first connector assembly further includes one or more support tab members and the second connector further includes one or more support tab connectors and wherein the support tab connectors are configured to receive at least a portion of the support tab members.

12. The connection assembly of claim 7, wherein the first connector assembly further includes at least one tube affixed to the wall and the second connector assembly further includes a partition perpendicular to the discontinuous seat, the partition having at least one aperture defined therein, the aperture configured to accept a fastener and align the fastener with the tube thus positioning the first connector assembly substantially parallel with the second connector assembly.

13. A method for assembling a lighting system comprising:

providing a first lighting fixture and a second lighting fixture, each lighting fixture comprising:

a first connector assembly (i) connectable to a first housing, (ii) including a protrusion having at least one wall perpendicular to a length of the first housing, and (iii) including a rotational fastener configured to be received through the wall; and a second connector assembly (i) connectable to a second housing, (ii) including a discontinuous seat having a first opening configured to receive the protrusion, and (iii) a second opening configured to receive the rotational fastener;

positioning the rotational fastener of the second lighting fixture into the second opening of the first lighting fixture forming a pivoting joint where the first connector assembly is located at a first position that is separated from the first connector assembly by an angle; and thereafter rotating the second lighting fixture about the pivoting joint to a second position co-linear to the second connector assembly and second housing.

14. The method claim 13, wherein the rotational fastener is configured to be removably connected from the wall of the protrusion.

15. The method of claim 13, wherein the rotational fastener is a first rotational fastener at a first position along the wall and a second mounting faster is positioned at a second position along the wall, the first rotational fastener configured to be received by the second opening and the second rotational fastener is configured to be received by a third opening positioned within the discontinuous seat.

16. The method of claim 13, the discontinuous seat further including a plurality of teeth positioned proximal to the second opening and configured to inhibit the rotational fastener from moving out of the second opening.

17. The method of claim 13, wherein the first connector assembly further includes one or more support tab members and the second connector further includes one or more support tab connectors and wherein the support tab connectors are configured to receive at least a portion of the support tab members.

* * * * *